US009640101B2

(12) United States Patent
Aoki et al.

(10) Patent No.: US 9,640,101 B2
(45) Date of Patent: May 2, 2017

(54) DISPLAY APPARATUS AND ELECTRONIC DEVICE INCLUDING THE SAME

(71) Applicant: Joled Inc., Tokyo (JP)

(72) Inventors: Takeshi Aoki, Kanagawa (JP); Iwao Ushinohama, Kanagawa (JP)

(73) Assignee: JOLED Inc., Tokyo (JP)

( * ) Notice: Subject to any disclaimer, the term of this patent is extended or adjusted under 35 U.S.C. 154(b) by 107 days.

(21) Appl. No.: 14/626,232

(22) Filed: Feb. 19, 2015

(65) Prior Publication Data

US 2015/0255018 A1 Sep. 10, 2015

(30) Foreign Application Priority Data

Mar. 7, 2014 (JP) ..... 2014-044979

(51) Int. Cl.
*G09G 3/20* (2006.01)

(52) U.S. Cl.
CPC ..... *G09G 3/20* (2013.01); *G09G 2310/0267* (2013.01); *G09G 2310/0291* (2013.01); *G09G 2320/041* (2013.01)

(58) Field of Classification Search
CPC ..... G09G 2310/0286; G09G 3/3674; G09G 3/30; G09G 3/32; G09G 3/3225; G09G 3/3208; G09G 3/3648; G09G 3/3266; G09G 3/3258
USPC ..... 345/98–100, 76, 77, 82, 87, 92, 214
See application file for complete search history.

(56) References Cited

U.S. PATENT DOCUMENTS 6,462,723 B1 * 10/2002 Yamazaki ..... H04N 9/3173 257/365
2005/0140606 A1 * 6/2005 Choi ..... G09G 3/3233 345/76
2007/0085803 A1 * 4/2007 Chu ..... G09G 3/3611 345/98
2008/0018629 A1 * 1/2008 Uchino ..... G09G 3/3233 345/205
2008/0055288 A1 * 3/2008 Kawada ..... G09G 3/2927 345/204
2008/0062097 A1 * 3/2008 Jeong ..... G09G 3/3266 345/84
2008/0143656 A1 * 6/2008 Hasegawa ..... G09G 3/3233 345/84
2011/0102409 A1 * 5/2011 Hayakawa ..... H01L 27/1225 345/212
2016/0042806 A1 * 2/2016 Ogawa ..... G11C 19/28 345/205

FOREIGN PATENT DOCUMENTS

JP 2011-100138 5/2011
JP 2013-044891 3/2013

* cited by examiner

*Primary Examiner* — Koosha Sharifi-Tafreshi
(74) *Attorney, Agent, or Firm* — Michael Best & Friedrich LLP

(57) ABSTRACT

There is provided a display apparatus including a display panel where display elements connected to a scanning line and a signal line are arrayed in a two dimensional matrix, and a driving circuit unit configured to drive the display panel, the driving circuit unit including a gate driver configured to feed a scanning signal to the scanning line such that a back gate voltage of a field effect transistor configuring an output buffer for generating the scanning signal is capable of controlling. Also, there is provided an electronic device including the display apparatus.

15 Claims, 12 Drawing Sheets

DISPLAY APPARATUS AND ELECTRONIC DEVICE INCLUDING THE SAME

CROSS REFERENCE TO RELATED APPLICATIONS

This application claims the benefit of Japanese Priority Patent Application JP 2014-044979 filed Mar. 7, 2014, the entire contents of which are incorporated herein by reference.

BACKGROUND

The present technology relates to a display apparatus and an electronic device including the display apparatus.

In recent years, a display apparatus has been developed to have a large sized screen using a flat type display panel such as a liquid crystal display panel and an electroluminescence display panel.

A signal waveform of a scanning line in the display panel is subjected to a transient effect of wiring resistance and parasitic capacitance and is changed thereby. Thus, at near and far ends of the driver producing a scanning signal, there is a difference in slowdown of the waveform. This may cause a difference in a signal write time of each pixel in the display panel, and shading may be generated on an image displayed.

In avoid this, capacitance of the pixel is changed depending on a distance from the driver (see Japanese Patent Application Laid-open No. 2011-100138). The shading is decreased by adding capacitance to the scanning line to positively slow down the signal, thereby decreasing the shading (see Japanese Patent Application Laid-open No. 2013-044891).

SUMMARY

The configurations described in the above-described Japanese Patent Application Laid-open No. 2011-100138 and Japanese Patent Application Laid-open No. 2013-044891 are fixed and are difficult to control setting corresponding to a production tolerance and a temperature change. With the configuration that a slew rate of the signal generated by the driver can be controlled and a signal waveform is slow downed in advance, an individual control corresponding to the production tolerance is possible.

For example, when an output stage of a driver is configured of a plurality of transistors connected in parallel and the number of the transistors to be operated is controlled, the individual control is possible. However, the control is not sequentially but discretely, which is undesirable.

In view of the circumstances as described above, there is a need for providing a display apparatus that a slew rate of a scanning signal can be sequentially controlled and shading can be effectively inhibited, and an electronic device including the display apparatus.

According to an embodiment of the present technology, there is provided a display apparatus including:

a display panel where display elements connected to a scanning line and a signal line are arrayed in a two dimensional matrix, and a driving circuit unit configured to drive the display panel, the driving circuit unit including a gate driver configured to feed a scanning signal to the scanning line such that a back gate voltage of a field effect transistor configuring an output buffer for generating the scanning signal is capable of controlling.

According to an embodiment of the present technology, there is provided an electronic device including a display apparatus, which includes:

a display panel where display elements connected to a scanning line and a signal line are arrayed in a two dimensional matrix, and a driving circuit unit configured to drive the display panel, the driving circuit unit including a gate driver configured to feed a scanning signal to the scanning line such that a back gate voltage of a field effect transistor configuring an output buffer for generating the scanning signal is capable of controlling.

By the display apparatus and the electronic device including the display apparatus according to an embodiment of the present technology, as the slew rate of the scanning signal can be controlled sequentially, the shading can be effectively inhibited.

These and other objects, features and advantages of the present technology will become more apparent in light of the following detailed description of best mode embodiments thereof, as illustrated in the accompanying drawings.

DETAILED DESCRIPTION OF EMBODIMENTS

Figure 1:
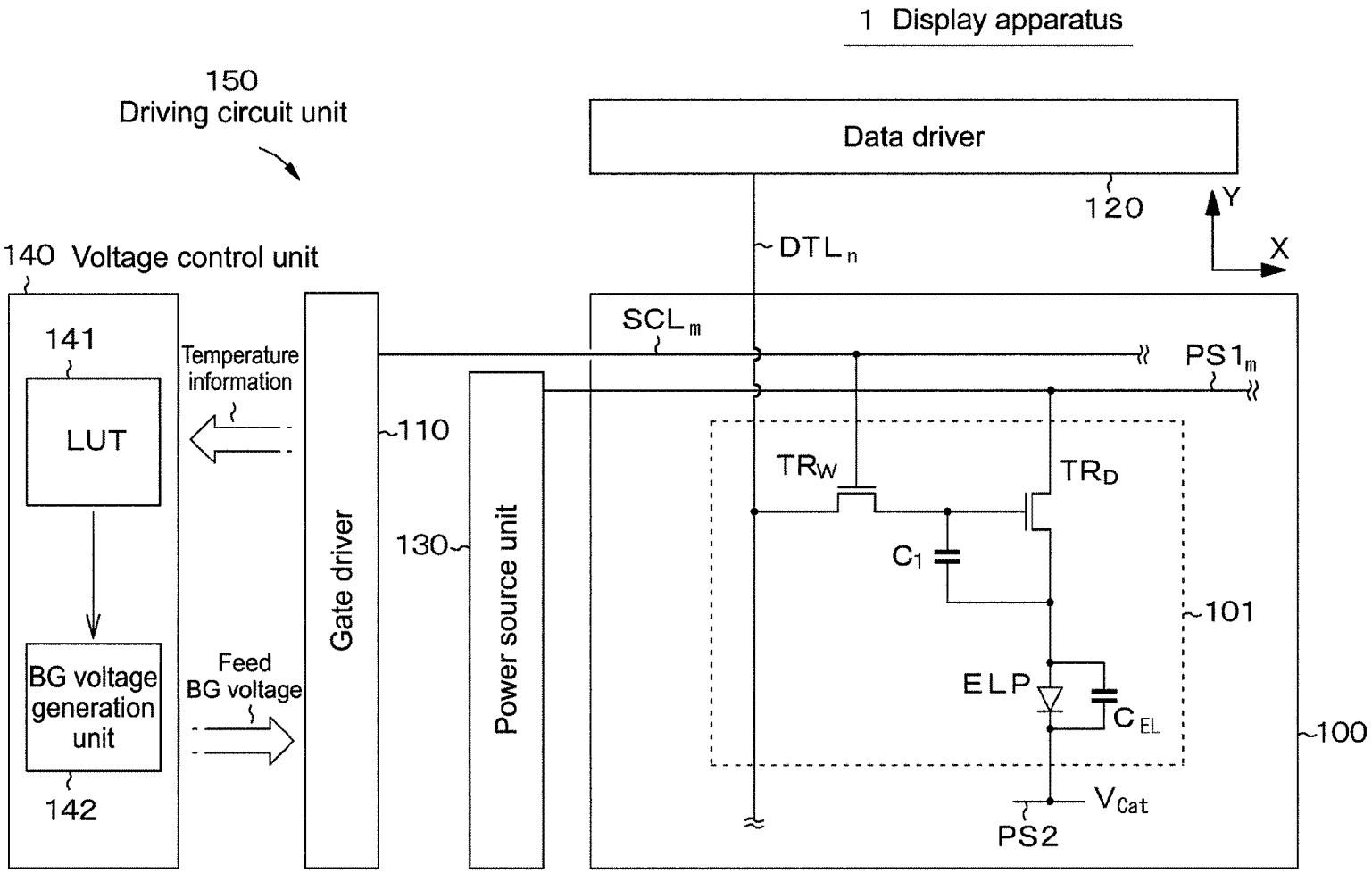
FIG. 1 is a conceptual diagram of a display apparatus according to a first embodiment.

Hereinafter, an embodiment of the present technology will be described with reference to the drawings. The present technology is not limited to the embodiments, various numerals and materials in the embodiments are provided for purposes of illustration only. In the following description, the same symbols are used for the same matter or the matter having the same function, an overlapped description will be omitted. The embodiments of the present technology will be described in the following order.

1. Display Apparatus of Present Technology, General Description
2. First Embodiment
3. Second Embodiment
4. Application Embodiment (Electronic Device Embodiment), Others

[Display Apparatus of Present Technology, General Description]

A display apparatus according to an embodiment of the present technology or the display apparatus included in an electronic device (hereinafter simply referred to as "a display apparatus according to the present technology") has a feature that:

an output buffer includes a first field effect transistor and a second field effect transistor, one source/drain region of the first transistor is connected to one source/drain region of the second transistor, a first voltage is applied to the other source/drain region of the first transistor, a second voltage is applied to the other source/drain region of the second transistor, and a back gate voltage of the first transistor and a back gate voltage of the second transistor are configured to be capable of controlling.

In this case, the back gate voltage of the first transistor and the back gate voltage of the second transistor may be configured to be capable of controlling independently. According to the feature, slowdown rise and fall in waveforms of the scanning signal generated by the output buffer can be controlled independently. For example, it can be applicable to the case that the slowdown rise in the waveforms of the scanning signal becomes greater than the slowdown fall in the waveforms of the scanning signal, which is a desirable countermeasure against shading.

The back gate voltage of the first transistor and the back gate voltage of the second transistor can be controlled based on temperature information of a gate driver. For example, it is contemplated that the waveform of the scanning signal may be changed by a temperature change of the gate driver accompanied by the operation of the display apparatus and that a shading degree may be changed. In this case, by acquiring the temperature information from a temperature sensor such as a thermal diode incorporated in the gate driver and by referring to a lockup table to control the back gate voltage, the change in the shading degree can be decreased.

In this case, the back gate voltage of the first transistor and the back gate voltage of the second transistor can be controlled based on the temperature information of the gate driver and temperature information of the display panel. For example, it is contemplated that a resistance value of a scanning line in the display panel is changed by a temperature change accompanied by the operation of the display apparatus to cause a change in a time constant upon signal propagation, thereby changing the shading degree. In this case, by acquiring the temperature information from a temperature sensor such as a thermistor attached to the display panel and by referring to a lockup table to control the back gate voltage, the change in the shading degree can be decreased. By this configuration, as controlling is performed based on the temperature information of the gate driver and temperature information of the display panel, the change in the shading degree can be more effectively decreased.

In the display apparatus according to the present technology including a variety of desirable configurations as described above, the output buffer may include the first transistor and the second transistor that have different conductive types or have a same conductive type.

In the display apparatus according to the present technology including a variety of desirable configurations as described above, the feature of the display element configuring the display panel is not especially limited. For example, the display element may include a current driving element or a voltage driving element. For example, the display panel may be an electroluminescence display panel or a liquid display panel.

The display panel may have a so-called monochrome display configuration or a color display configuration. In the color display configuration, one pixel includes a plurality of sub-pixels, specifically, one pixel includes three sub-pixels: a red display sub-pixel, a green display sub-pixel and a blue display sub-pixel. Moreover, the color display may be configured of one set including these three sub-pixels and one or more of sub-pixels (for example, one set including the three sub-pixels and a sub-pixel for displaying white to improve brightness, one set including the three sub-pixels and a sub-pixel for displaying a complementary color to widen a color reproduction range, one set including the three sub-pixels and a sub-pixel for displaying yellow to widen a color reproduction range and one set including the three sub-pixels and a sub-pixel for displaying yellow and cyan to widen a color reproduction range).

Non-limiting examples of a pixel value of the display panel include VGA (640, 480), S-VGA (800, 600), XGA (1024, 768), APRC (1152, 900), S-XGA (1280, 1024), U-XGA (1600, 1200), HD-TV (1920, 1080), Q-XGA (2048, 1536), (1920, 1035), (720, 480), (1280, 960) for image display resolution.

For example, the driving circuit unit used by the present technology can be configured of well-known circuit elements such as a logic circuit, an arithmetic circuit, a memory element and an operational amplifier. For example, the gate driver may be a driver IC (Integrated Circuit).

The feature of the electronic device including the display apparatus is not especially limited. There is an illustrative electronic device that displays a video signal inputted from outside or a video signal generated inside as an image or a video.

A variety of conditions shown in the present specification should be strictly or substantially satisfied. Some design or production variability may be allowable.

[First Embodiment]

The first embodiment relates to the display apparatus according to the present technology.

FIG. 1 is a conceptual diagram of a display apparatus according to the first embodiment. A display apparatus 1 includes a display panel 100 where each display element 101 connected to a scanning line SCL and a signal line DTL is arrayed in a two dimensional matrix, and a driving circuit unit 150 configured to drive the display panel.

The driving circuit unit 150 includes a gate driver 110 feeding a scanning signal to the scanning line SCL such that a back gate voltage of a field effect transistor configuring an output buffer for generating the scanning signal can be controlled. The gate driver 110 is composed, for example, of a CMOS integrated circuit.

In the first embodiment, the driving circuit unit 150 further includes a data driver 120, a power source unit 130 and a voltage control unit 140 besides the gate driver 110.

In the display panel 100, the display element 101 including a current driving light emitting part ELP and a pixel circuit for driving the light emitting part ELP are connected to the scanning line SCL extending to a row direction (an X direction in FIG. 1) and to the data line DTL extending to a column direction (a Y direction in FIG. 1) and is arrayed in a two dimensional matrix. A voltage corresponding to a brightness of the image to be displayed is applied to the data line DTL from the data driver 120. The scanning signal is fed to the scanning line SCL from the gate driver 110. The light emitting part ELP configuring the display elements 101 is composed of one electroluminescence light emitting part. As a matter of drawing convenience, FIG. 1 shows one display element 101, more specifically, a wire connection relationship about an $(n, m)^{th}$ display element 101 as described later.

The display panel 100 further includes power feeding lines PS1 connected to the display element 101 arrayed in the row direction and a second power feeding line PS2 connected commonly to all display elements 101. A predetermined driving voltage is fed to the power feeding lines PS1 from the power source unit 130. A common voltage $V_{Cat}$ (for example, a ground potential) is fed to the second power feeding line PS2.

Although not shown in FIG. 1, an area displaying an image (display area) of the display panel 100 is composed of a total of N×M display elements 101 arrayed in the two dimensional matrix where N represents the number in the row direction and M represents the number in the column direction.

Each number of the scanning line SCL and the power feeding lines PS1 is M. An $m^{th}$ (where m=1, 2, . . . M) row of the display element 101 is connected to an $m^{th}$ scanning line $SCL_m$ and an $m^{th}$ feeding line $PS1_m$ and configures one display element row. In FIG. 1, only the power feeding line $PS1_m$ is shown.

The number of the data line DTL is N. An $n^{th}$ (where n=1, 2, . . . N) display element 101 is connected to an $n^{th}$ data line $DTL_n$. In FIG. 1, only the data line DLTn is shown.

The display apparatus 1 is a monochrome display and one display element 101 configures one pixel. The display apparatus 1 is line-sequentially scanned by the scanning signal from the gate driver 110. The display element 101 positioned at the $m^{th}$ row and the $n^{th}$ column is hereinafter referred to the $(n, m)^{th}$ display element 101 or an $(n, m)^{th}$ pixel.

As a matter of description convenience, a basic operation of displaying an image by the display apparatus 1 will be firstly described.

In the display apparatus 1, each display element 101 configuring the N pixel arrayed in the $m^{th}$ row is concurrently driven. In other words, a timing of light emission/no light emission of each N display element 101 arranged along the row direction is controlled per row to which the display element belongs. A scanning period (so-called horizontal scanning period) per row upon line-sequential scanning of the display apparatus 1 is less than (1/FR)×(1/M) seconds, where a display frame rate of the display apparatus 1 is represented by FR (frame per second).

A gradation signal $vD_{Sig}$ corresponding to the image to be displayed is inputted to the data driver 120 of the display apparatus 1 from an apparatus (not shown), for example. Among the gradation signals $vD_{Sig}$ inputted, the gradation signal corresponding to the $(n, m)^{th}$ display element 101 represents as $vD_{Sig(n, m)}$. A video signal voltage applied to the data line $DTL_n$ by the data driver 120 based on the value of the gradation signal $vD_{Sig(n, m)}$ is represented by voltage $V_{Sig(n, m)}$.

Each display element 101 at least includes the current driving light emitting part ELP, a write transistor $TR_W$, a driving transistor $TR_D$ and a capacitance $C_1$. Once a current flows to the light emitting part ELP via a source/drain region of the driving transistor $TR_D$, light is emitted.

The capacitance $C_1$ is used to hold a voltage of the gate electrode to the source region of the driving transistor $TR_D$ (so-called gate-source voltage). While the display element 101 emits light, one source/drain region (a side connected to the power feeding line PS1 in FIG. 1) of the driving transistor $TR_D$ works as the drain region, and the other source/drain region (one end of the light emitting part ELP, specifically a side connected to an anode electrode) works as the source region. The one electrode and the other electrode of the capacitance $C_1$ are connected to the other source/drain region of the driving transistor $TR_D$ and the gate electrode, respectively.

The write transistor $TR_W$ includes a gate electrode connected to the scanning line SCL, one source/drain region connected to the data line DTL and other source/drain region connected to the gate electrode of the driving transistor $TR_D$.

The gate electrode of the driving transistor $TR_D$ is connected to the other source/drain region of the write transistor $TR_W$ and the other electrode of the capacitance $C_1$, the other source/drain region of the driving transistor $TR_D$ is connected to one electrode of the capacitance $C_1$ and the anode electrode of the light emitting part ELP.

The other end of the light emitting part ELP (specifically, a cathode electrode) is connected to the second power feeding line PS2. A capacitance of the light emitting part ELP is represented by a symbol $C_{EL}$.

When the write transistor $TR_W$ is in a conduction state by the scanning signal from the gate driver 110 with a voltage $V_{Si}$ corresponding to the brightness of the image to be displayed being fed to the data line DTL from the data driver 120, the voltage corresponding to the brightness of the image to be displayed is written into the capacitance $C_1$. After the write transistor $TR_W$ is in a non-conduction state, a current flows to the driving transistor $TR_D$ depending on the voltage held at the capacitance $C_1$ and the light emitting part ELP emits light.

The basic operation of displaying an image by the display apparatus 1 is described above. Next, for a better understanding of the present technology, a relationship between slowdown of the scanning signal propagating the scanning line SCL and shading. Then, a reference embodiment for changing a slew rate of the scanning signal and problems thereof will be described.

Figure 2:
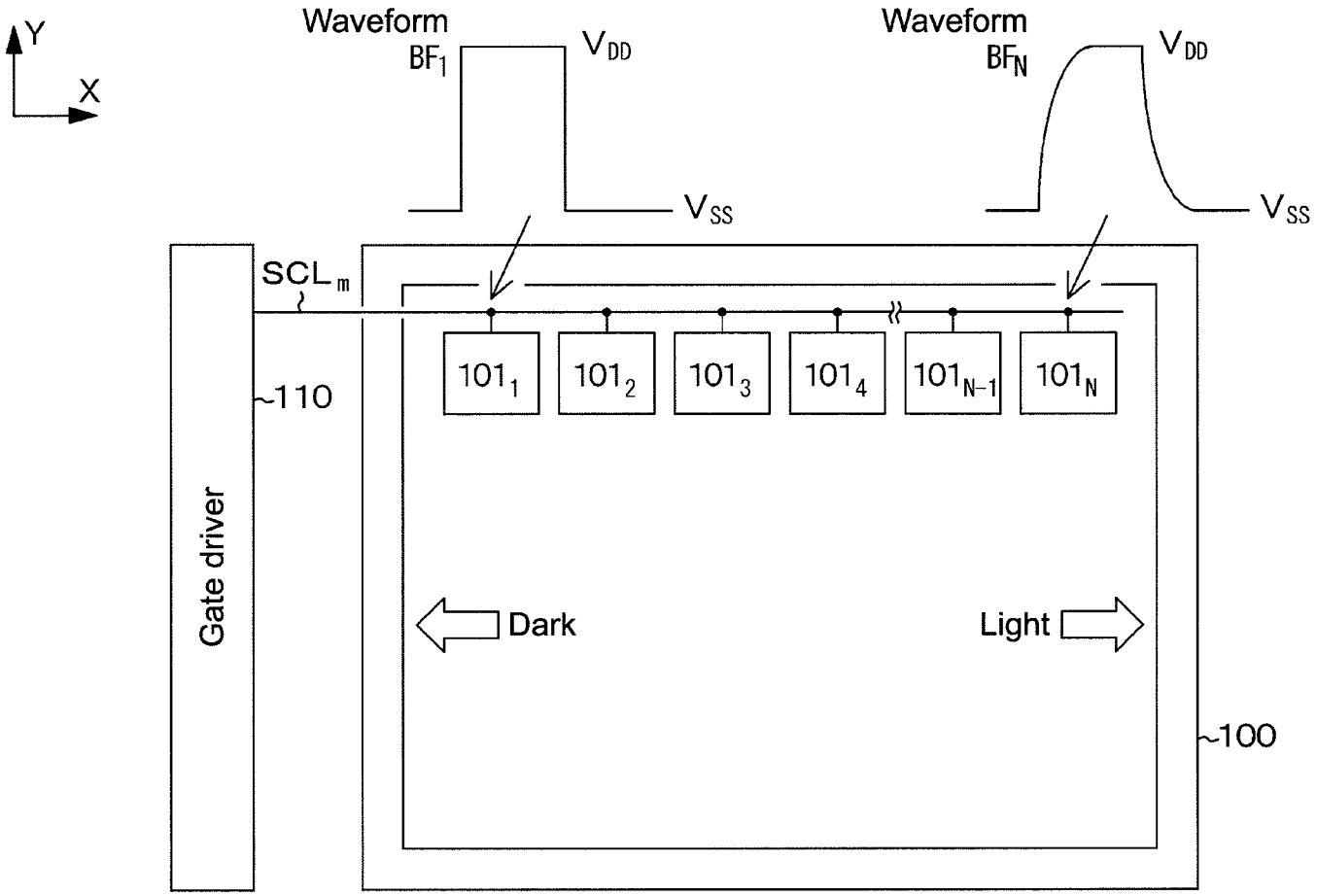
FIG. 2 is a schematic diagram illustrating a relationship between a waveform change of a scanning signal propagating a scanning line and a lightness change in a display area.

FIG. 2 is a schematic diagram illustrating a relationship between a waveform change of the scanning signal propagating the scanning line and a lightness change in the display area.

In general, the rise and fall of the signal propagating wiring become slowdown and deform due to distributed capacitance and wiring resistance. As a signal propagation path is longer, the degree of the deformation becomes significant. When the scanning signal in the scanning line SCL is taken in consideration, a path length of a display element $101_1$ nearest to the gate driver 110 (display element arranged at a left end) is different from a path length of a display element $101_N$ farthest from the gate driver 110 (display element arranged at a right end).

Accordingly, when the gate driver 110 feeds an ideal rectangular pulse to the scanning line SCL, a less slowdown pulse shown as a waveform $BF_1$ is applied to the display element $101_1$ and a pulse having a slowdown rise and fall shown as a waveform $BF_N$ is applied to the display element $101_N$. It arises a difference between a period of the conduction state of the write transistor $TR_W$ in the display element $101_1$ and a period of the conduction state of the write transistor $TR_W$ in the display element $101_N$.

The slowdown of the waveform gets greater approaching the right end. As a result, the period of the conduction state of the write transistor $TR_W$ in the display element 101 changes gradually from the left end to the right end of the display panel. This may cause a phenomenon (shading) that the image becomes light or dark from the left end to the right end. FIG. 2 schematically shows the case where the right end becomes dark and the left end becomes light.

The degree of shading can be decreased by controlling the slew rate of the pulse generated by the gate driver 110. Hereinafter, referring to FIG. 3, it will be described.

Figure 3:
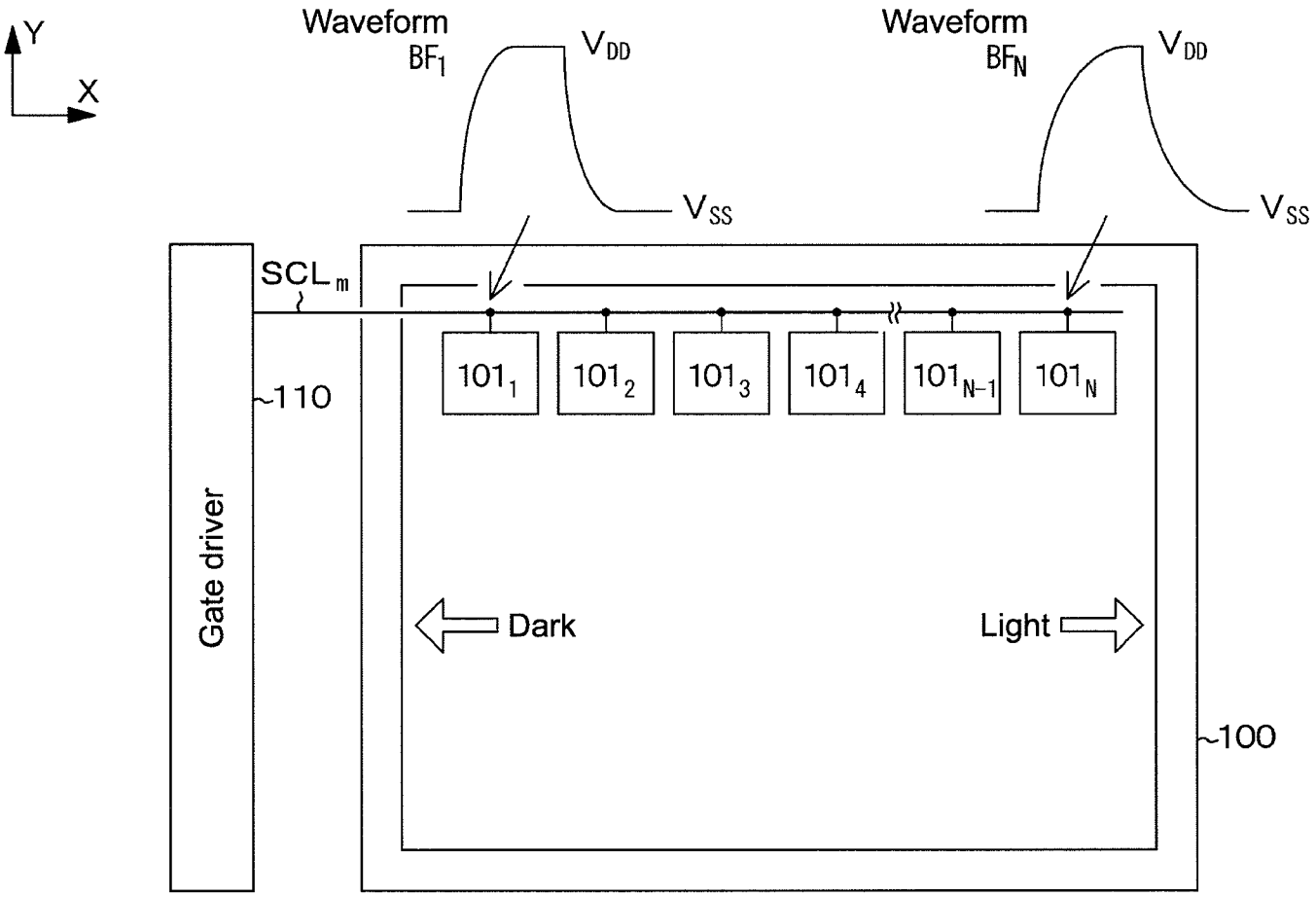
FIG. 3 is a schematic diagram illustrating an operation when a gate driver feeds a scanning signal having slowdown rise and fall by controlling a slew rate.

FIG. 3 is a schematic diagram illustrating an operation when the gate driver 110 feeds the scanning signal having slowdown rise and fall by controlling the slew rate.

Also in this case, the waveform $BF_N$ having a slowdown rise/fall lower than the waveform $BF_1$ is applied to the display element $101_N$. However, as the waveform $BF_1$ already has a slowdown rise/fall, the period of the conduction state of the write transistor $TR_W$ in the display element 101 less changes gradually from the left end to the right end. As a result, the shading may be decreased.

Figure 4:
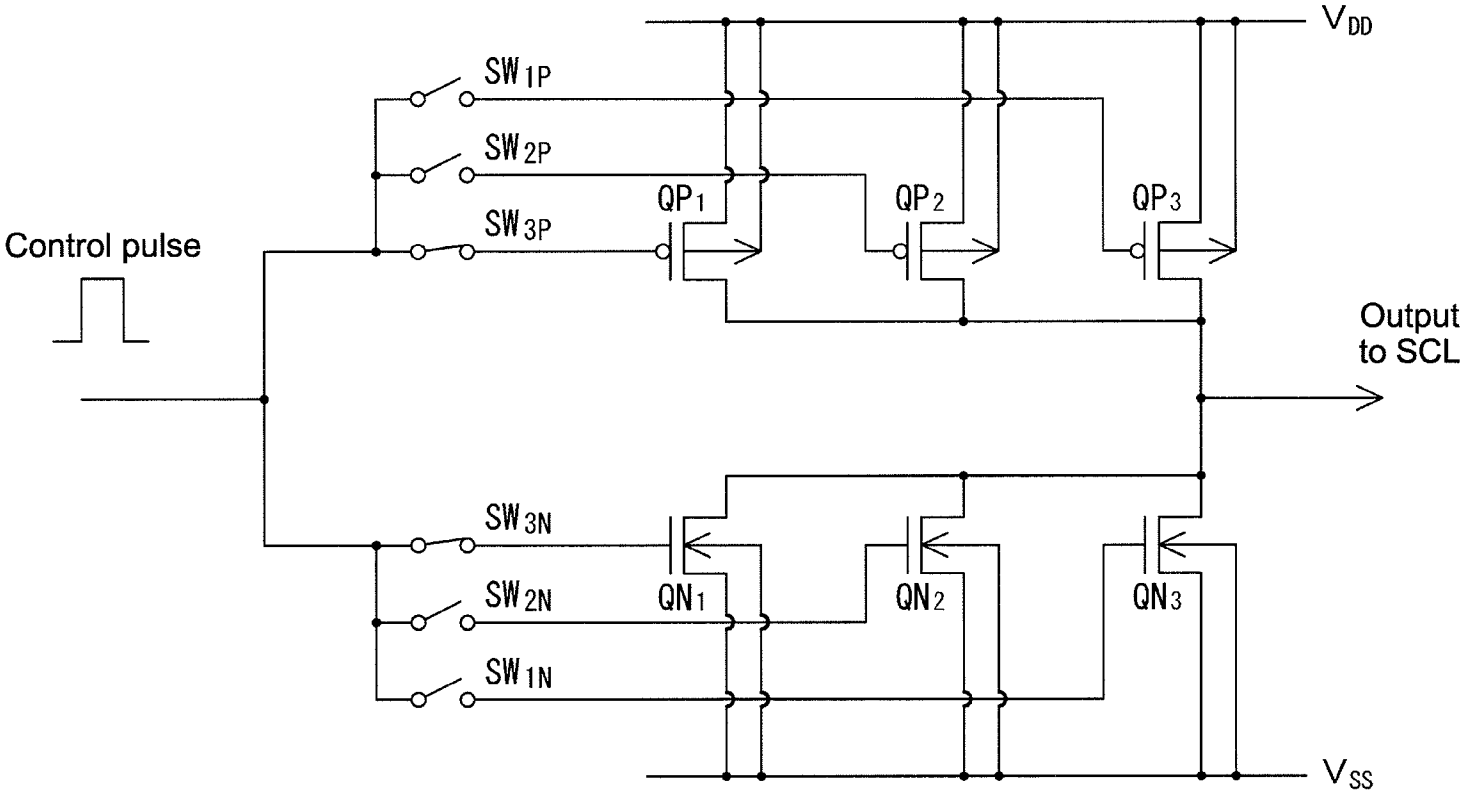
FIG. 4 is a schematic circuit diagram illustrating a reference embodiment that can control a slew rate of a signal.

FIG. 4 is a schematic circuit diagram illustrating a reference embodiment that can control the slew rate of the signal.

The circuit shown in FIG. 4 shows a reference embodiment of the output buffer of the gate driver. The output buffer is equivalent to a plurality of groups where p channel type transistors QP and n channel type transistors QN are serially connected is connected in parallel. FIG. 4 shows the embodiment including three groups (a group of transistors $QP_1$ and $QN_1$, a group of transistors $QP_2$ and $QN_2$, a group of transistors $QP_3$ and $QN_3$).

One source/drain region of the transistors $QP_1$, $QP_2$ and $QP_3$ and one source/drain region of the transistors $QN_1$, $QN_2$ and $QN_3$ are connected, which configures an output part of the output buffer.

A first voltage $V_{DD}$ (for example, 20 volts) is applied to the other source/drain region of the transistors $QP_1$, $QP_2$ and $QP_3$ and a second voltage $V_{SS}$ (for example, 0 volt) is applied to the other source/drain region of the transistors $QN_1$, $QN_2$ and $QN_3$.

For example, switches $SW_{1P}$, $SW_{2P}$, $SW_{3P}$, $SW_{1N}$, $SW_{2N}$, $SW_{3N}$ shown in FIG. 4 are controlled to operate a group of transistors $QP_1$, $QN_1$, a group of transistors $QP_2$, $QN_2$ and a group of transistors $QP_3$, $QN_3$. As a result, on-resistance of the output buffer is small and a voltage feed capacity to the scanning line SCL is high. Accordingly, a signal having a less slowdown waveform (great slew rate waveform) is fed to the scanning line SCL.

Based on the above-described status, when the switches $SW_{3P}$ and $SW_{3N}$ shown in FIG. 4 are in the non-conduction state, only the group of transistors $QP_1$, $QN_1$ and the group of transistors $QP_2$, $QN_2$ are operated. Therefore, the on-resistance of the output buffer is increased and the voltage feed capacity is decreased. Accordingly, a signal having a relatively great slowdown waveform is fed to the scanning line SCL.

When the switches $SW_{2P}$, $SW_{2N}$, $SW_{3P}$ and $SW_{3N}$ shown in FIG. 4 are in the non-conduction state, only the group of transistors $QP_1$, $QN_1$ is operated. Therefore, the on-resistance of the output buffer is further increased. Accordingly, a signal having a further great slowdown waveform is fed to the scanning line SCL.

In this way, when the number of the transistor groups to be operated is changed, the slew rate of the signal can be controlled. However, the slew rate only can be controlled gradually and it is less suitable to control the slew rate individually in view of variability of the display panel.

Heretofore, the reference embodiment for changing the slew rate of the scanning signal and problems thereof are described. Next, the configuration of the voltage control unit and the gate driver of the display apparatus 1 according to the first embodiment will be described.

Figure 5:
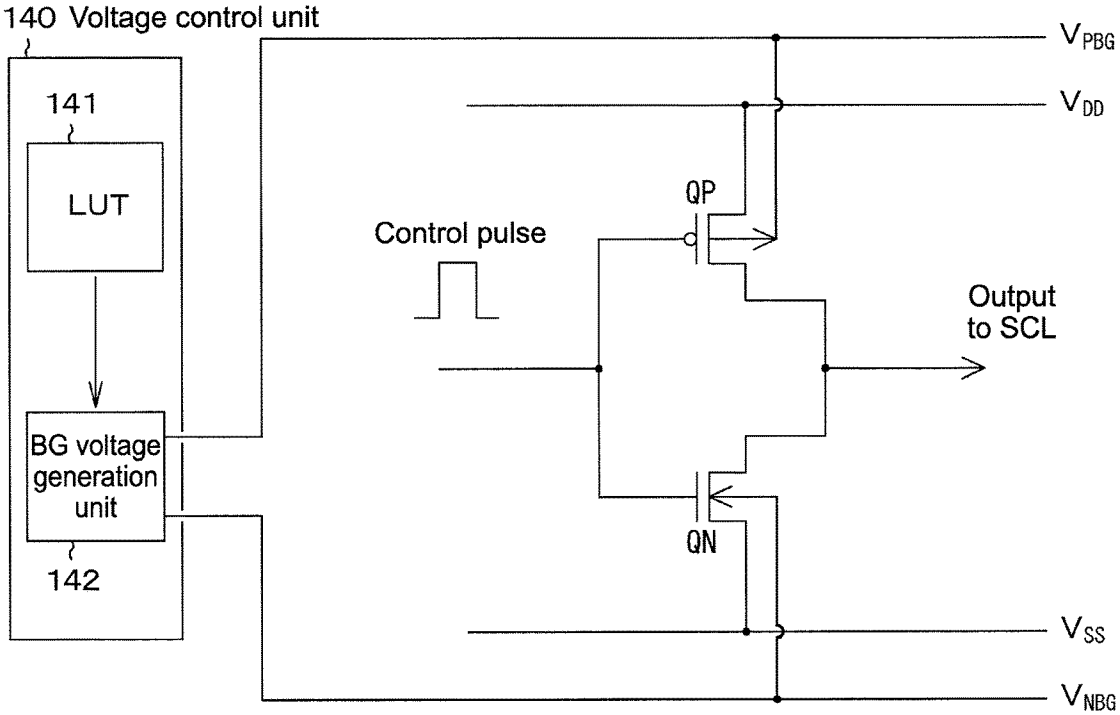
FIG. 5 is a schematic circuit diagram illustrating configurations of a voltage control unit and a gate driver of the display apparatus according to the first embodiment.

FIG. 5 is a schematic circuit diagram illustrating the configurations of the voltage control unit and the gate driver of the display apparatus according to the first embodiment.

As shown in FIG. 5, the output buffer of the gate driver 110 includes a first field effect transistor QP and a second field effect transistor QN, one source/drain region of the first transistor QP is connected to one source/drain region of the second transistor QN, a first voltage $V_{DD}$ is applied to the other source/drain region of the first transistor QP, a second voltage $V_{SS}$ is applied to the other source/drain region of the second transistor QN, and a back gate voltage $V_{PGB}$ of the first transistor QP and a back gate voltage $V_{NGB}$ of the second transistor QN are configured to be capable of controlling.

The embodiment shown in FIG. 5 is configured of the first transistor QP and the second transistor QN having different conductive types. In other words, the first transistor QP is a p channel type transistor (PMOS) and the second transistor QN is an n channel type transistor (NMOS).

The voltage $V_{PGB}$ and the voltage $V_{NGB}$ are fed to a back gate of the first transistor QP and a back gate of the second transistor QN from the voltage control unit 140, specifically, a back gate voltage generation unit 142.

The back gate voltage generation unit 142 (as a matter of drawing convenience, it is represented as a BG voltage generation unit in FIG. 5) is configured of an operational amplifier, for example, and is controlled for operation by a control circuit (not shown) included in the voltage control unit 140. The voltage $V_{PGB}$ and the voltage $V_{NGB}$ are configured to be capable of controlling independently. In this way, the back gate voltage of the first transistor QP and the back gate voltage of the second transistor QN are configured to be capable of controlling independently.

In the circuit shown in FIG. 4 described earlier, the first voltage $V_{DD}$ is fixedly applied to the back gates of the transistors $QP_1$ to $QP_3$, and the second voltage $V_{SS}$ is fixedly applied to the back gates of the transistors $QN_1$ to $QN_3$.

In contrast, in the back gate voltage generation unit 142 shown in FIG. 5, a voltage $V_{PBG}$ is configured to be capable of controlling within a range from $V_{DD}$ to ($V_{DD}$+10 [volt]), and a voltage $V_{NBG}$ is configured to be capable of controlling within a range from $V_{SS}$ to ($V_{SS}$−10 [volt]).

Figure 6:
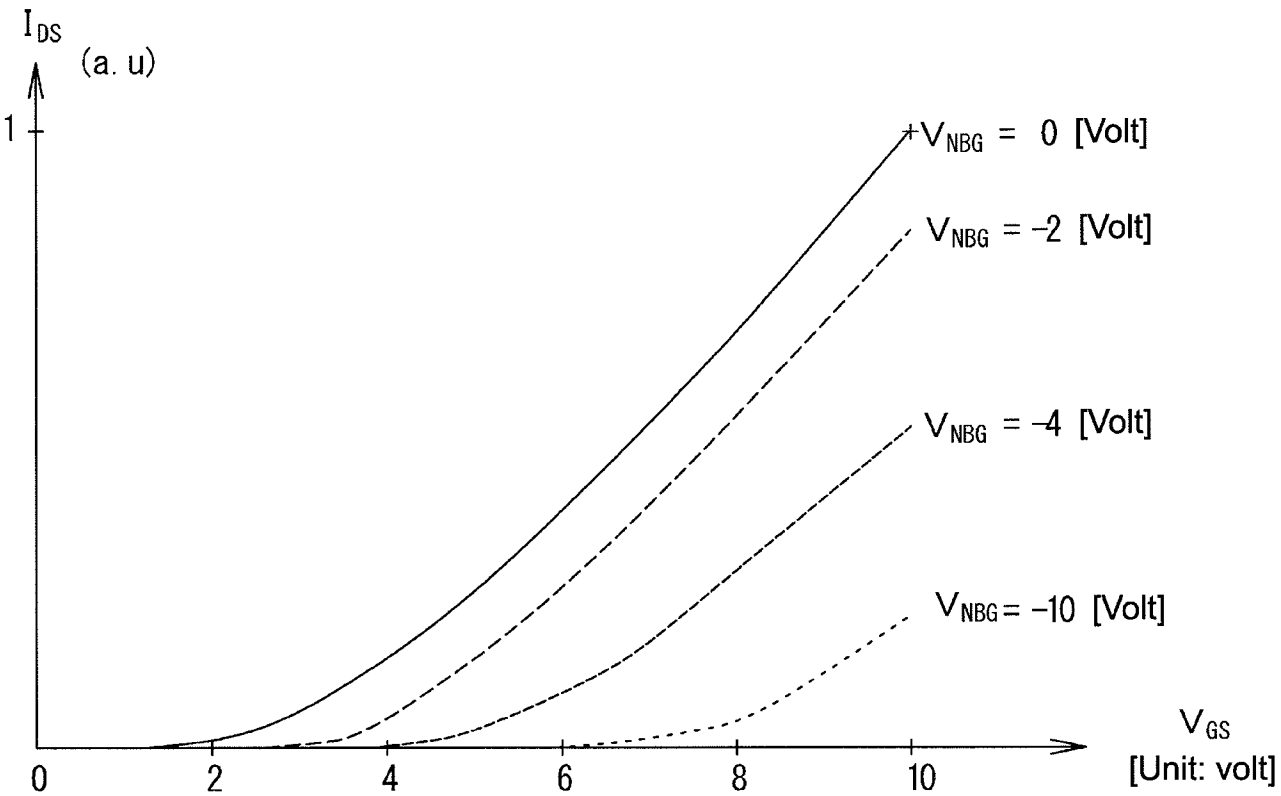
FIG. 6 is a schematic graph illustrating an $I_{DS}$-$V_{GS}$ property when a back gate voltage of an NMOS transistor is controlled.

Here, an operation change of the transistor by controlling the back gate voltage will be qualitatively described referring to FIG. 6.

FIG. 6 is a schematic graph illustrating an $I_{DS}$-$V_{GS}$ property when a back gate voltage of an NMOS transistor is controlled.

Specifically, while the drain voltage is set to 10 [volts], the $I_{DS}$-$V_{Gs}$ property is shown when a back gate voltage $V_{NBG}$ is set to 0, −2, −4 and −10 [volts]. Note that as a matter of drawing convenience, the drain current $I_{DS}$ normalized is shown.

As shown in FIG. 6, even when a gate-source voltage $V_{Gs}$ is the same, the drain current $I_{DS}$ may be changed by changing the back gate voltage $V_{NBG}$. Although not shown in the graph, also in a PMOS transistor, the drain current is changed by changing the back gate voltage $V_{PBG}$.

Thus, by controlling the back gate voltage of the transistors $QP_1$ and $QN_1$ configuring the output buffer of the gate driver 110, the slew rate of the scanning signal generated can be controlled.

The voltage control unit 140 shown in FIG. 5 includes a look up table (LUT) 141 on which predetermined parameters are stored, for example. A control circuit (not shown) in the voltage control unit 140 refers to the look up table 141 and controls the operation of the back gate voltage generation unit 142. For example, when the look up table 141 is composed of a table having a numerical value of 8 bits, the operation of the back gate voltage generation unit 142 can be controlled in 256 stages. Thus, in view of the variability of the display panel, it is easily possible to control the operation of the back gate voltage generation unit 142.

As the gate driver 110 is operated, the temperature increases. This may cause a phenomenon that an operation point of the transistor is changed such that the slew rate of the signal outputted to the scanning line SCL is changed.

In the first embodiment, the back gate voltage of the first transistor QP and the back gate voltage of the second transistor QN are configured to be controlled based on the temperature information of the gate driver 110.

The control circuit (not shown) included in the voltage control unit 140 acquires the temperature information of the gate driver 110 based on a detection result of the temperature sensor such as a thermal diode incorporated in the gate driver 110, for example, (see FIG. 1). Then, the control circuit refers to the look up table 141 based on the temperature information and controls the back gate voltage generation unit 142 based on the result.

Figure 7:
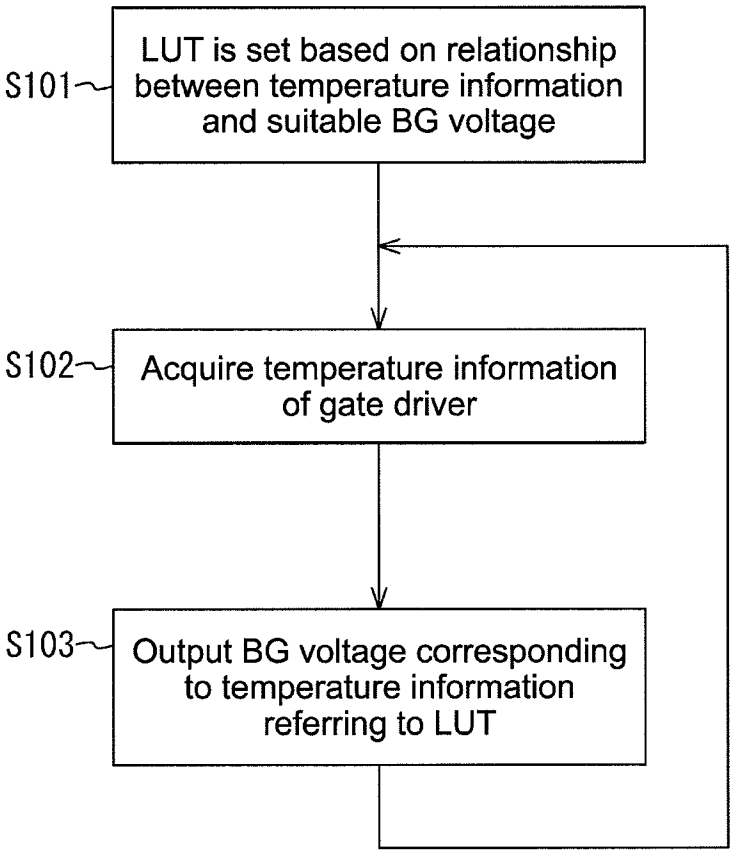
FIG. 7 is a schematic flow chart illustrating a basic operation of the display apparatus according to the first embodiment.

FIG. 7 is a schematic flow chart illustrating a basic operation of the display apparatus according to the first embodiment.

A suitable value is assigned to the look up table 141 in a delivery inspection of the display apparatus 1 in a factory, for example, based on the variability of the display panel 100 and a temperature property of the gate driver 110 (Step S101). For example, by measuring a property change of shading of the display apparatus 1 in an actual operation inspection, the suitable value may be set, as appropriate.

When the display apparatus 1 after shipment is operated, the temperature information of the gate driver 110 (Step S102) is acquired and the look up table (LUT) is referred. Based on the result, the back gate voltage generation unit 142 is controlled (Step S103). The control circuit (not shown) incorporated into the voltage control unit 140 repeats Step S102 and Step S103 at adequate time intervals. The time interval may be set depending on the specification of the display apparatus, as appropriate.

As described above, in the display apparatus according to the first embodiment, the shading can be controlled independently in view of the variability of the display panel as well as the temperature property of the gate driver.

Figure 8B:
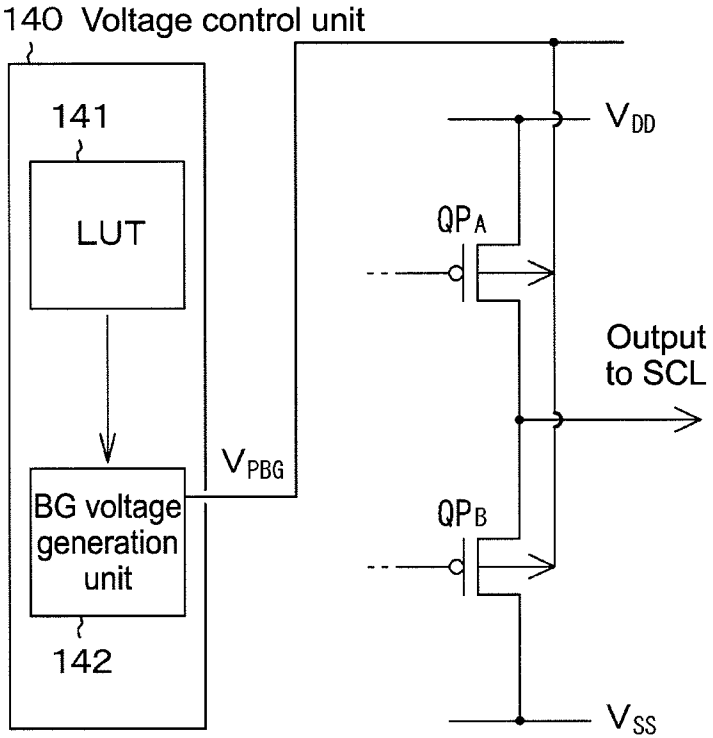
FIGS. 8A and 8B each is a schematic circuit diagram illustrating a configuration that same conductive type transistors are used on an output stage of the gate driver.
Figure 8A:
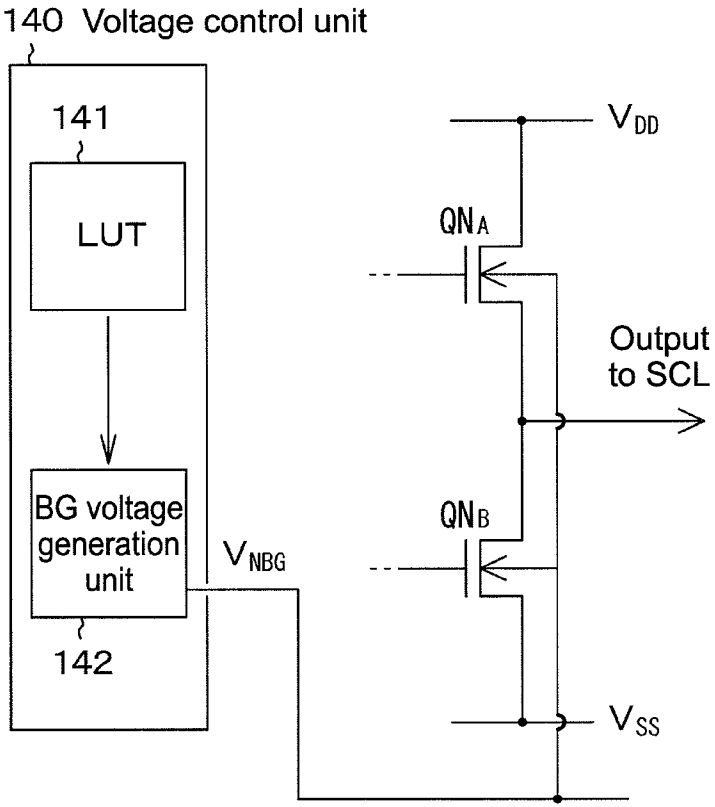

In the above description, the gate driver is the CMOS. For example, the gate driver may be composed of only NMOS or PMOS. FIG. 8A shows an illustrative configuration of the gate driver composed of the NMOS, and FIG. 8B shows an illustrative configuration of the gate driver composed of the PMOS.

[Second Embodiment]

The second embodiment also relates to the display apparatus according to the present technology.

The display apparatus according to the second embodiment has the same configuration as the display apparatus according to the first embodiment except that the back gate voltage is controlled based on the temperature information of the display panel.

Figure 9:
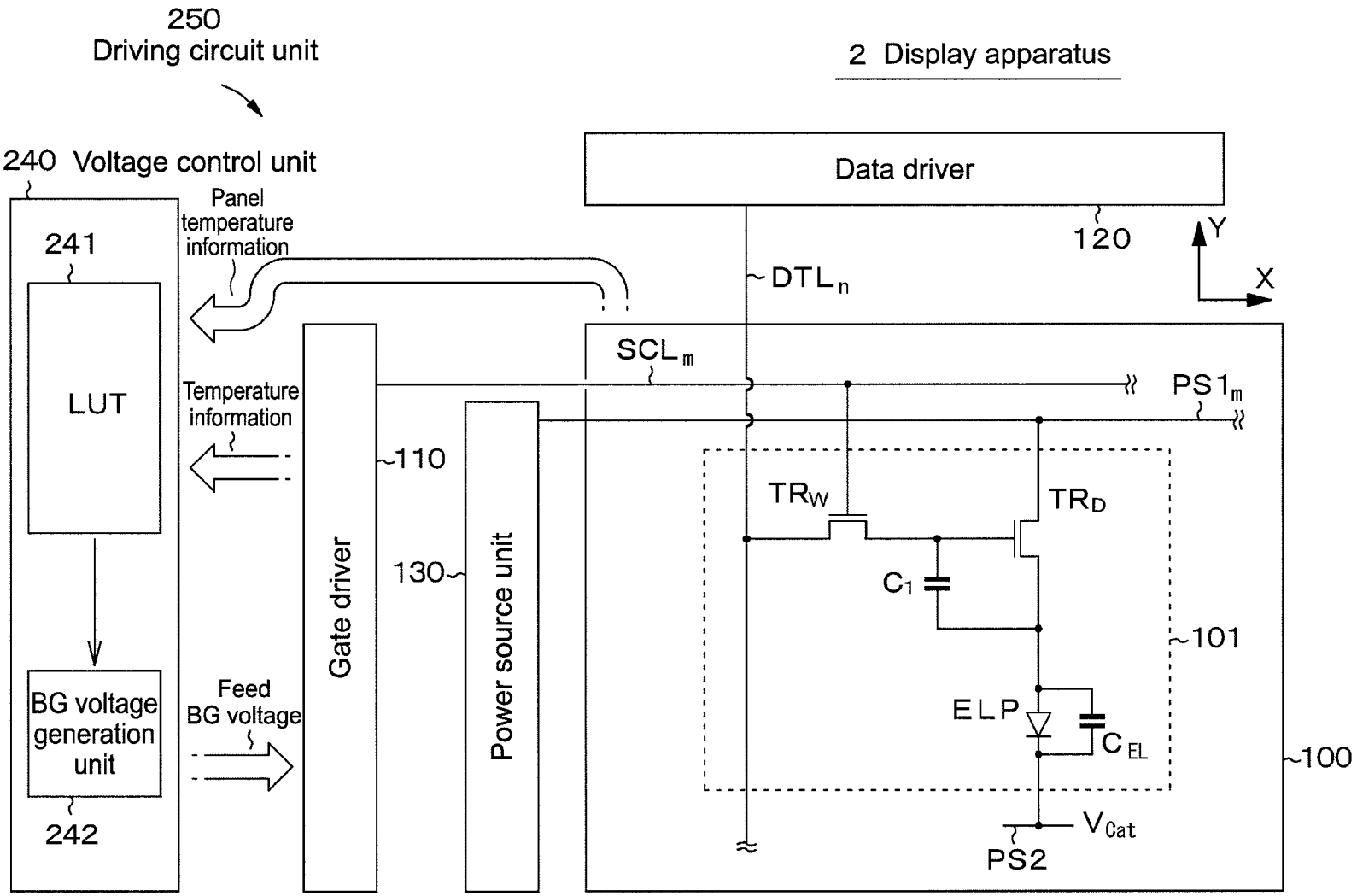
FIG. 9 is a conceptual diagram of a display apparatus according to a second embodiment.

FIG. 9 is a conceptual diagram of the display apparatus according to the second embodiment. A display apparatus 2 includes the display panel 100 where each display element 101 connected to the scanning line SCL and the signal line DTL is arrayed in a two dimensional matrix, and a driving circuit unit 250 configured to drive the display panel.

The driving circuit unit 250 includes the gate driver 110 feeding the scanning signal to the scanning line SCL such that the back gate voltage of the field effect transistor configuring the output buffer for generating the scanning signal can be controlled. The gate driver 110 is composed, for example, of the CMOS integrated circuit.

In the second embodiment, the driving circuit unit 250 further includes the data driver 120, the power source unit 130 and a voltage control unit 240 besides the gate driver 110. As a schematic circuit diagram illustrating the configurations of the voltage control unit and the gate driver of the display apparatus according to the second embodiment, the voltage control unit 140, the look up table 141 and the back gate voltage generation unit (BG voltage generation unit) 142 may be taken as a voltage control unit 240, a look up table 241 and a back gate voltage generation unit (BG voltage generation unit) 242 in FIG. 5.

As described in the first embodiment referring to FIG. 2, the rise and fall of the signal propagating wiring become slowdown and deform due to distributed capacitance and wiring resistance. In general, as the temperature increases, the resistance value of the wiring gets larger. Accordingly, when the display apparatus 2 being left in a stopped state for a long time is operated, the temperature of the display panel 100 is gradually increased until it returns to a steady state and the resistance value of the scanning line SCL is also gradually increased. Therefore, it is contemplated that the slew rate of the scanning signal propagating the scanning line SCL is changed as the temperature of the display panel 100 increases.

In the display apparatus 2 according to the second embodiment, the controlling is performed in view of the temperature information of the display panel 100 in addiction to the temperature information of the gate driver 110. In other words, the back gate voltage of the first transistor and the back gate voltage of the second transistor are controlled based on temperature information of the gate driver 110. The temperature information of the display panel 100 may be acquired based on a detection result of a temperature sensor such as a thermistor attached to a rear face of the display panel 100, for example.

Figure 10:
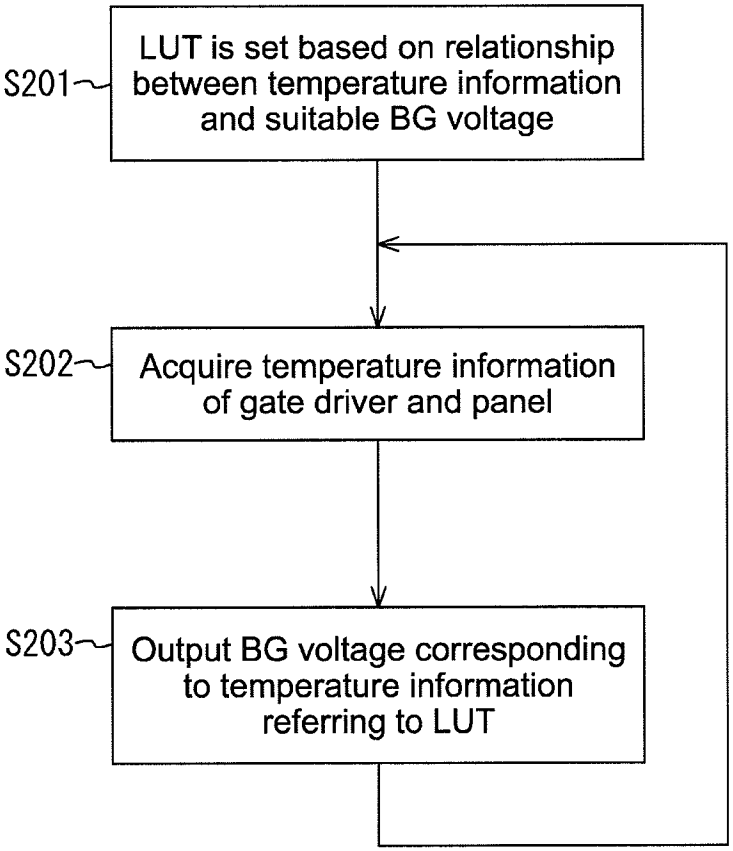
FIG. 10 a schematic flow chart illustrating an operation of the display apparatus according to the second embodiment.

FIG. 10 a schematic flow chart illustrating an operation of the display apparatus according to the second embodiment.

A suitable value is assigned to the look up table 241 in a delivery inspection of the display apparatus 2 in a factory, for example, based on the variability of the display panel 100, the temperature property of the gate driver 110 and the temperature property of the display panel 100 (Step S201). For example, by measuring a property change of shading of the display apparatus 2 in an actual operation inspection, the suitable value may be set, as appropriate.

When the display apparatus 2 after shipment is operated, the temperature information of the gate driver 110 and the temperature property of the display panel 100 (Step S202) is acquired and the look up table (LUT) is referred. Based on the result, the back gate voltage generation unit 242 is controlled (Step S203). The control circuit (not shown)

incorporated into the voltage control unit 240 repeats Step S202 and Step S203 at adequate time intervals.

As described above, in the display apparatus according to the second embodiment, the shading can be controlled independently in view of the variability of the display panel as well as the temperature properties of the gate driver 110 and the display panel.

[Application Embodiment (Electronic Device Embodiment), Others]

An application embodiment of the above-described display apparatus to an electronic device will be described. As an example, there is an electronic device that displays a video signal inputted from outside or generated inside as an image or a video.

(Application Embodiment 1)

Figure 11A:
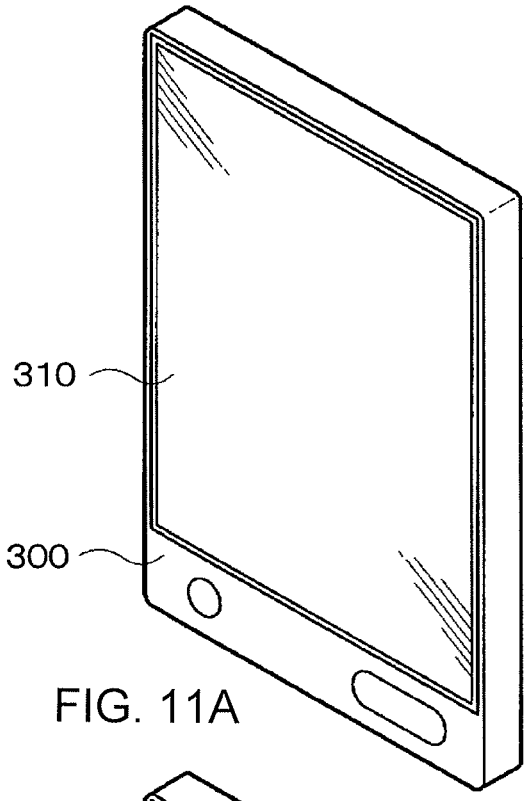
FIGS. 11A and 11B each is a perspective view showing an appearance of a first application embodiment of the display apparatus.
Figure 11B:
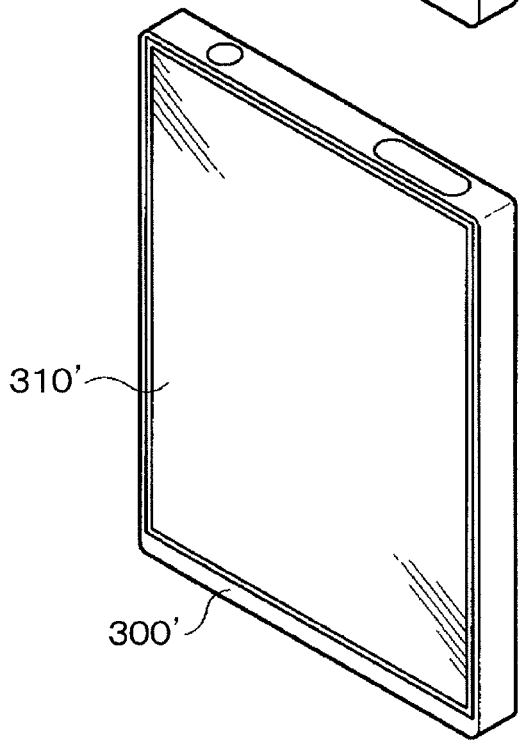

FIGS. 11A and 11B each shows an appearance of a smartphone to which the display apparatus according to the above-described embodiments is applied. Smartphones 300 and 300' include display units 310 and 310', for example. The display units 310 and 310' are configured of the display apparatus according to the above-described embodiments. By applying the display apparatus according to the above-described embodiments, the shading can be effectively inhibited, thereby contributing to an improved quality of the smartphones 300 and 300'.

(Application Embodiment 2)

Figure 12:
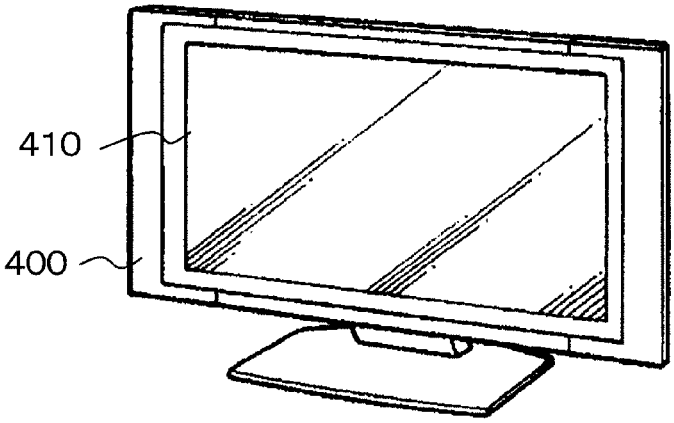
FIG. 12 is a perspective view showing an appearance of a second application embodiment of the display apparatus.

FIG. 12 shows an appearance of a television apparatus to which the display apparatus according to the above-described embodiments is applied. A television apparatus 400 includes a video display screen 410, for example. The video display screen 410 is configured of the display apparatus according to the above-described embodiments. By applying the display apparatus according to the above-described embodiments, the shading can be effectively inhibited, thereby contributing to an improved quality of the television apparatus 400.

While the present technology is described herein with reference to illustrative embodiments for particular applications, it should be understood that the present technology is not limited thereto and various modifications can be practiced based on the technical spirits of the present technology. The numerical values, the structures, the substrates, the raw materials and the processes in the above-described embodiments are only illustrative, and any numerical values, structures, substrates, raw materials and processes different therefrom may be used, as appropriate.

The present technology may have the following configurations.

[1] A display apparatus, including:

a display panel where display elements connected to a scanning line and a signal line are arrayed in a two dimensional matrix, and a driving circuit unit configured to drive the display panel, the driving circuit unit including a gate driver configured to feed a scanning signal to the scanning line such that a back gate voltage of a field effect transistor configuring an output buffer for generating the scanning signal is capable of controlling.

[2] The display apparatus according to [1] above, in which an output buffer includes a first field effect transistor and a second field effect transistor, one source/drain region of the first transistor is connected to one source/drain region of the second transistor, a first voltage is applied to the other source/drain region of the first transistor, a second voltage is applied to the other source/drain region of the second transistor, and a back gate voltage of the first transistor and a back gate voltage of the second transistor are configured to be capable of controlling.

[3] The display apparatus according to [2] above, in which the back gate voltage of the first transistor and the back gate voltage of the second transistor are configured to be capable of controlling independently.

[4] The display apparatus according to [2] above, in which the back gate voltage of the first transistor and the back gate voltage of the second transistor are controlled based on temperature information of the gate driver.

[5] The display apparatus according to [4] above, in which the back gate voltage of the first transistor and the back gate voltage of the second transistor are controlled based on the temperature information of the gate driver and temperature information of the display panel.

[6] The display apparatus according to any one of [2] to [5] above, in which the first transistor and the second transistor are configured of transistors having different conductive types.

[7] The display apparatus according to any one of [2] to [5] above, in which the first transistor and the second transistor are configured of transistors having a same conductive type.

[8] An electronic device, including a display apparatus, the display apparatus including:

a display panel where display elements connected to a scanning line and a signal line are arrayed in a two dimensional matrix, and a driving circuit unit configured to drive the display panel, the driving circuit unit including a gate driver configured to feed a scanning signal to the scanning line such that a back gate voltage of a field effect transistor configuring an output buffer for generating the scanning signal is capable of controlling.

[9] The electronic device according to [8] above, in which an output buffer includes a first field effect transistor and a second field effect transistor, one source/drain region of the first transistor is connected to one source/drain region of the second transistor, a first voltage is applied to the other source/drain region of the first transistor, a second voltage is applied to the other source/drain region of the second transistor, and a back gate voltage of the first transistor and a back gate voltage of the second transistor are configured to be capable of controlling.

[10] The electronic device according to [9] above, in which the back gate voltage of the first transistor and the back gate voltage of the second transistor are configured to be capable of controlling independently.

[11] The electronic device according to [9] above, in which the back gate voltage of the first transistor and the back gate voltage of the second transistor are controlled based on temperature information of the gate driver.

[12] The electronic device according to [11] above, in which the back gate voltage of the first transistor and the back gate voltage of the second transistor are controlled based on the temperature information of the gate driver and temperature information of the display panel

[13] The electronic device according to any one of [9] to [12] above, in which the first transistor and the second transistor are configured of transistors having different conductive types.

[14] The electronic device according to any one of [9] to [12] above, in which the first transistor and the second transistor are configured of transistors having a same conductive type.

It should be understood by those skilled in the art that various modifications, combinations, sub-combinations and alterations may occur depending on design requirements and other factors insofar as they are within the scope of the appended claims or the equivalents thereof.

What is claimed is:

1. A display apparatus, comprising:

a display panel where display elements connected to a scanning line and a signal line are arrayed in a two dimensional matrix, and a driving circuit unit configured to drive the display panel, the driving circuit unit including a gate driver configured to feed a scanning signal to the scanning line such that a back gate voltage of a field effect transistor configuring an output buffer for generating the scanning signal is controllable, wherein the output buffer includes a first transistor and a second transistor, a source/drain region of the first transistor is connected to a source/drain region of the second transistor, a first voltage is applied to another source/drain region of the first transistor, a second voltage is applied to another source/drain region of the second transistor, a back gate voltage of the first transistor and a back gate voltage of the second transistor are controllable based on temperature information of the gate driver.

2. The display apparatus according to claim 1, wherein the back gate voltage of the first transistor and the back gate voltage of the second transistor are independently controllable.

3. The display apparatus according to claim 1, wherein the back gate voltage of the first transistor and the back gate voltage of the second transistor are controllable based on the temperature information of the gate driver and temperature information of the display panel.

4. The display apparatus according to claim 1, wherein the first transistor and the second transistor are configured of transistors having different conductive types.

5. The display apparatus according to claim 1, wherein the first transistor and the second transistor are configured of transistors having a same conductive type.

6. An electronic device, comprising:

the display apparatus according to claim 1.

7. A display apparatus, comprising:

display elements arrayed in a two dimensional matrix, a scanning line is electrically connected to a gate electrode for one of the display elements;

an output buffer circuitry configured to output a scanning signal to the scanning line, the output buffer includes a first transistor and a second transistor;

voltage control circuitry configured to output a first back gate voltage to a back gate of the first transistor and a second back gate voltage to a back gate of the second transistor, a gate electrode for the first transistor is electrically connected to a gate electrode for the second transistor, wherein a source/drain region for the first transistor and a source/drain region for the second transistor are electrically connected to the scanning line, the source/drain region for the first transistor is electrically connected to the source/drain region for the second transistor, wherein the display elements are in a display panel, the display panel includes a display panel temperature sensor that is configured to detect a temperature of the display panel, wherein the voltage control circuitry is configured to adjust the first back gate voltage from a voltage to another voltage when the display panel temperature sensor detects a change in the temperature of the display panel.

8. The display apparatus according to claim 7, wherein the voltage control circuitry is configured to adjust a voltage level of the first back gate voltage.

9. A display apparatus, comprising:

display elements arrayed in a two dimensional matrix, a scanning line is electrically connected to a gate electrode for one of the display elements;

an output buffer circuitry configured to output a scanning signal to the scanning line, the output buffer includes a first transistor and a second transistor;

voltage control circuitry configured to output a first back gate voltage to a back gate of the first transistor and a second back gate voltage to a back gate of the second transistor, a gate electrode for the first transistor is electrically connected to a gate electrode for the second transistor, wherein a source/drain region for the first transistor and a source/drain region for the second transistor are electrically connected to the scanning line, the source/drain region for the first transistor is electrically connected to the source/drain region for the second transistor, wherein the display elements are in a display panel, the display panel includes a display panel temperature sensor that is configured to detect a temperature of the display panel, wherein the voltage control circuitry is configured to adjust the first back gate voltage from a first voltage level to a second voltage level when the gate driver temperature sensor detects a change in the temperature of the gate driver.

10. The display apparatus according to claim 7, wherein another source/drain region for the first transistor is configured to receive a first voltage and another source/drain region for the second transistor is configured to receive a second voltage that differs from the first voltage.

11. The display apparatus according to claim 7, wherein a signal line is electrically connected to a source/drain region for said one of the display elements.

12. The display apparatus according to claim 7, wherein the first transistor and the second transistor are of a same conductivity type.

13. The display apparatus according to claim 7, wherein a conductivity type of the first transistor differs from a conductivity type of the second transistor.

14. The display apparatus according to claim 13, wherein the conductivity type of the first transistor is opposite to the conductivity type of the second transistor.

15. An electronic device, comprising:

the display apparatus according to claim 7.

* * * * *